US012808165B2

(12) United States Patent
Walgren

(10) Patent No.: US 12,808,165 B2
(45) Date of Patent: Nov. 24, 2026

(54) MICROTRENCHING BLADES WITH REPLACEABLE CUTTERS

(71) Applicant: The Charles Machine Works, Inc., Perry, OK (US)

(72) Inventor: Michael C. Walgren, Lake Havasu City, AZ (US)

(73) Assignee: The Charles Machine Works, Inc., Perry, OK (US)

( * ) Notice: Subject to any disclaimer, the term of this patent is extended or adjusted under 35 U.S.C. 154(b) by 856 days.

(21) Appl. No.: 18/172,545

(22) Filed: Feb. 22, 2023

(65) Prior Publication Data

US 2023/0265641 A1 Aug. 24, 2023

Related U.S. Application Data

(60) Provisional application No. 63/313,093, filed on Feb. 23, 2022.

(51) Int. Cl.
*E02F 9/28* (2006.01)
*E02F 5/10* (2006.01)

(52) U.S. Cl.
CPC ..... *E02F 9/2866* (2013.01); *E02F 5/101* (2013.01); *E02F 9/2833* (2013.01); *E02F 9/285* (2013.01); *E02F 9/2858* (2013.01)

(58) Field of Classification Search
CPC ..... E02F 9/2866; E02F 9/2833; E02F 9/285; E02F 9/2858; E02F 5/101; E02F 5/08; E02F 3/241; E21C 25/18; E21C 35/19; E21C 35/197; E21C 35/18; E21C 35/183; E21C 35/1833; E21C 35/1837
See application file for complete search history.

(56) References Cited

U.S. PATENT DOCUMENTS 2,675,603 A 4/1954 Goehle
3,287,793 A 11/1966 Battersby
3,614,164 A * 10/1971 Davis ..... E21C 35/19 299/83.1

(Continued)

FOREIGN PATENT DOCUMENTS

KR 301017001.00 7/2019

OTHER PUBLICATIONS

Ditch Witch Catalog, Earliest available date Dec. 31, 2016 [Online], [Site visited Jul. 1, 2020] Available From Internet, URL:<https://www.ditchwitch.com/catalog/diggingsystems/html5/index.html?page=68&noflash> (Year: 2016).

*Primary Examiner* — Robert E Pezzuto
(74) *Attorney, Agent, or Firm* — Tomlinson McKinstry, P.C.

(57) ABSTRACT

A replaceable tooth assembly. A number of tooth assemblies are provided round the periphery of a microtrenching blade. The assemblies include a cartridge, usually welded to the periphery of the microtrenching blade, and a tooth, which has a projection or flange shaped to fit within a cavity formed in the cartridge. The cartridge and projection each have a transverse hole formed in them, which, when aligned, form a continuous passage for placement of a removable pin which is used to join the cartridge to the tooth body. The cartridge may also have a more radially-aligned channel which intersects the cavity, which a rubber shim may be placed in. Such a shim reduces the relative vibration between the tooth and cartridge, improving life and reducing wear.

14 Claims, 11 Drawing Sheets

(56) References Cited

U.S. PATENT DOCUMENTS

| | | | | |
|---|---|---|---|---|
| 3,818,561 | A | 6/1974 | Montana et al. | |
| 4,011,783 | A | 3/1977 | Mobley | |
| 4,114,494 | A | 9/1978 | Budke et al. | |
| 4,222,298 | A | 9/1980 | James | |
| 4,563,929 | A | 1/1986 | Ringlee et al. | |
| 4,604,933 | A | 8/1986 | Lesher et al. | |
| D293,074 | S | 12/1987 | Inoue | |
| 5,129,296 | A | 7/1992 | Wayne | |
| 5,184,412 | A * | 2/1993 | Kopinski | E02F 9/2841 37/457 |
| 5,211,212 | A * | 5/1993 | Carlson | A01G 23/091 144/34.1 |
| 5,647,264 | A | 7/1997 | Proulx | |
| 5,758,561 | A | 6/1998 | Curtsinger et al. | |
| 6,364,227 | B1 | 4/2002 | Dorscht | |
| 6,386,469 | B1 | 5/2002 | Meister et al. | |
| D459,171 | S | 6/2002 | Hong | |
| D492,170 | S | 6/2004 | Auger | |
| D559,638 | S | 1/2008 | Park | |
| 7,815,136 | B2 | 10/2010 | Arnston | |
| 8,898,913 | B1 | 12/2014 | Lones | |
| D796,291 | S | 9/2017 | Sewell et al. | |
| D796,292 | S | 9/2017 | Sewell et al. | |
| 10,704,227 | B2 | 7/2020 | Sewell | |
| 10,751,817 | B1 | 8/2020 | Smith | |
| 2002/0000150 | A1 | 1/2002 | Kurelek et al. | |
| 2002/0002892 | A1 | 1/2002 | DiSabatino | |
| 2003/0029297 | A1 | 2/2003 | Haughton et al. | |
| 2007/0095190 | A1 | 5/2007 | Asada | |
| 2008/0017009 | A1 | 1/2008 | Setliff | |
| 2008/0142118 | A1 | 6/2008 | Corfe et al. | |
| 2010/0170379 | A1 | 7/2010 | MacLennan et al. | |
| 2011/0100510 | A1 | 5/2011 | Hinchliff | |
| 2012/0132052 | A1 | 5/2012 | Chen | |
| 2013/0125724 | A1 | 5/2013 | MacLennan et al. | |
| 2013/0161428 | A1 | 6/2013 | Hongo | |
| 2014/0196818 | A1 | 7/2014 | Weinberg et al. | |
| 2014/0260878 | A1 | 9/2014 | Bird | |
| 2015/0083275 | A1 | 3/2015 | Paumier et al. | |
| 2016/0044876 | A1 | 2/2016 | Green | |
| 2016/0135388 | A1 | 5/2016 | Leonardi et al. | |
| 2017/0012572 | A1 | 1/2017 | Takano et al. | |
| 2017/0120355 | A1 | 5/2017 | Brutscher et al. | |
| 2017/0350093 | A1 | 12/2017 | Sewell | |
| 2018/0215031 | A1 | 8/2018 | Sundberg et al. | |
| 2018/0272447 | A1 | 9/2018 | Ando et al. | |
| 2018/0290149 | A1 | 10/2018 | Ver Steeg et al. | |
| 2019/0001424 | A1 | 1/2019 | Baratta | |
| 2019/0240861 | A1 | 8/2019 | Daining et al. | |
| 2020/0047267 | A1 | 2/2020 | Nakano et al. | |
| 2020/0139463 | A1 | 5/2020 | Bird | |
| 2020/0222998 | A1 | 7/2020 | Hall | |
| 2020/0222999 | A1 | 7/2020 | Curry, Jr. | |
| 2020/0316700 | A1 | 10/2020 | Elliston et al. | |
| 2022/0372874 | A1 | 11/2022 | Lu | |
| 2023/0151733 | A1 * | 5/2023 | Lu | E21C 25/18 299/29 |

* cited by examiner

MICROTRENCHING BLADES WITH REPLACEABLE CUTTERS

SUMMARY

The present invention is directed to an apparatus. The apparatus comprises a disc and a plurality of tooth assemblies. The disc has a center and a terminal periphery. The plurality of tooth assemblies comprise a cartridge and a tooth. The cartridge is attached to the terminal periphery of the disc and has a cavity opening away from the center of the disc. The tooth is configured for removable attachment to the cartridge.

In another aspect, the invention is directed to a method of replacing a tooth in a microtrenching blade. The tooth is located in one of a plurality of cartridges affixed to an outer periphery of the blade. The method comprises removing a cross-pin from a continuous passage formed by a transverse hole in the cartridge and an aligned transverse hole in a projection in the tooth and removing the projection from a cavity in the cartridge.

In another aspect, the invention is directed to a tooth assembly. The tooth assembly is configured for placement about the periphery of a microtrenching blade. The tooth assembly comprises a cartridge and a tooth. The cartridge has an eternal surface and an internal cavity defining an internal profile. The internal cavity opens to the external surface of the cartridge at a first side. The cavity is intersected by a transverse hole extending from a second side of the external surface to an opposed third side of the external surface. The tooth comprises a body and a projection extending from the body. The projection defines an external profile complementary to the internal profile of the internal cavity of the cartridge. A transverse hole is formed in the projection. The transverse hole of the projection and the transverse hole of the cartridge form a continuous passage when the projection is situated within the internal cavity of the cartridge.

DETAILED DESCRIPTION

Thin rotary blades used to create microtrenches—the common name for narrow trenches for the installation of cable in a hard surface such as asphalt or concrete, are known in the art. Typically, a plurality of teeth are welded or pinned to the blade body. The blade is rotationally driven to uncover a narrow trench, such as in a microtrenching application. The teeth typically include a carbide or other hardened tip, which resists wear due to the repeated contact between the tooth and the surface being removed. An example of a microtrenching unit are given in U.S. Pat. No. 10,337,168, issued to Sewell, and in U.S. Pat. No. 8,375,605, issued to Ruhl, et. al., the contents of each being incorporated by reference herein.

A microtrenching assembly, such as the systems shown in the incorporated documents, may place wear on teeth, even when hardened cutters and hardfacing are used on forward-facing surfaces. Typically, when a welded tooth is broken or damaged, the entire blade must be taken offline to repair the tooth. Such repair is expensive and results in project downtime. As a result, an apparatus which allows commonly worn parts to be readily replaced more quickly would reduce machine downtime and improve efficiency.

The present invention is directed to an apparatus which allows the repair of broken teeth without significant repair being required, while keeping the teeth stable and durable within the blade.

Figure 1:
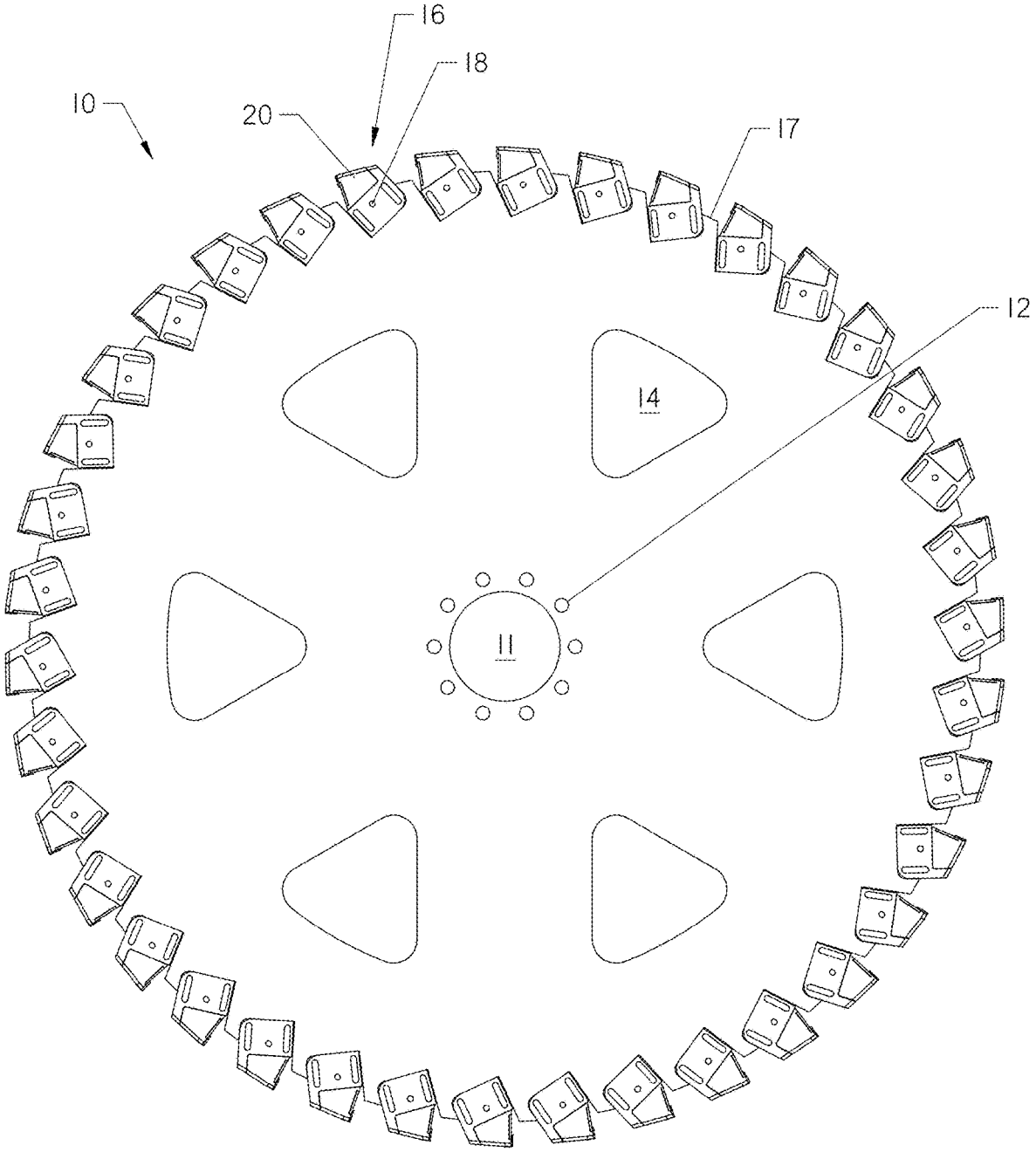
FIG. 1 is a side view of a microtrenching blade.
Figure 2A:
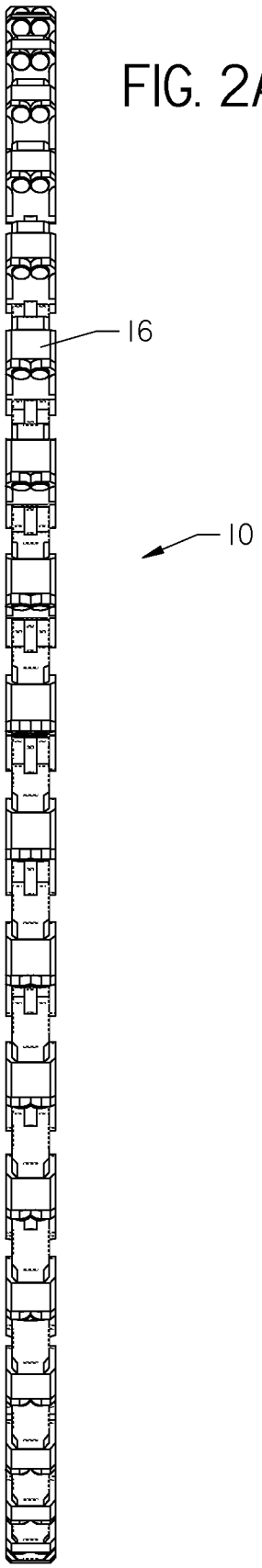
FIG. 2A is an edge view of the microtrenching blade of FIG. 1.
Figure 2B:
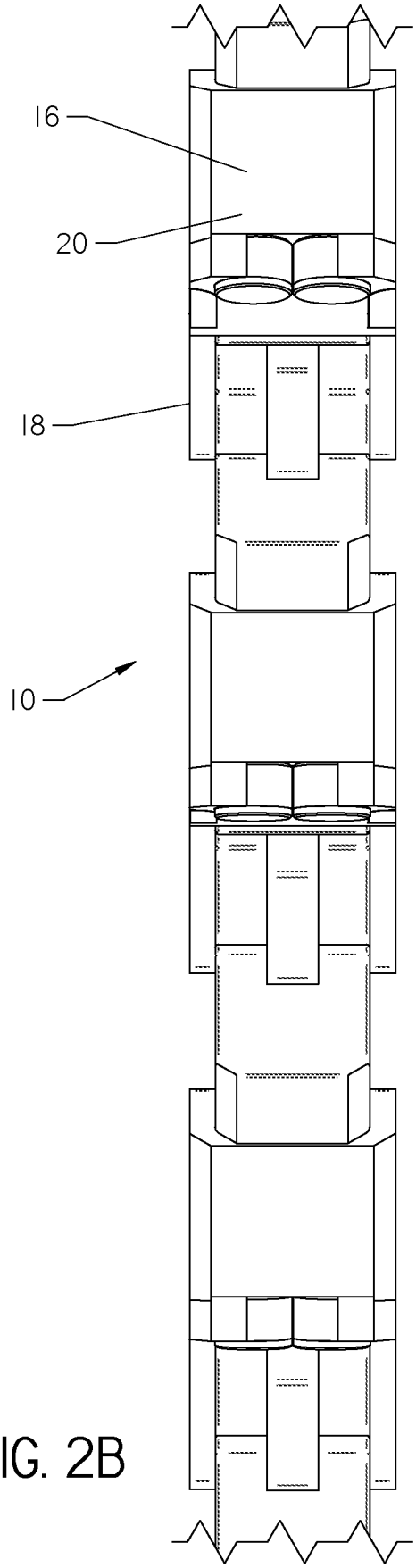
FIG. 2B is a close-up edge view of the microtrenching blade of FIG. 1.

With reference to the figures, and to FIGS. 1 and 2A-2B in particular, a blade 10 is shown therein. The blade 10 has a mounting location 12 located at its center 11, for connection to a rotating hub (not shown) of a machine, such as a compact utility vehicle. As shown, the blade 10 has holes 14 in its disc-shaped profile. These holes 14 reduce the weight of the blade 10 without compromising its structural integrity.

Figure 3:
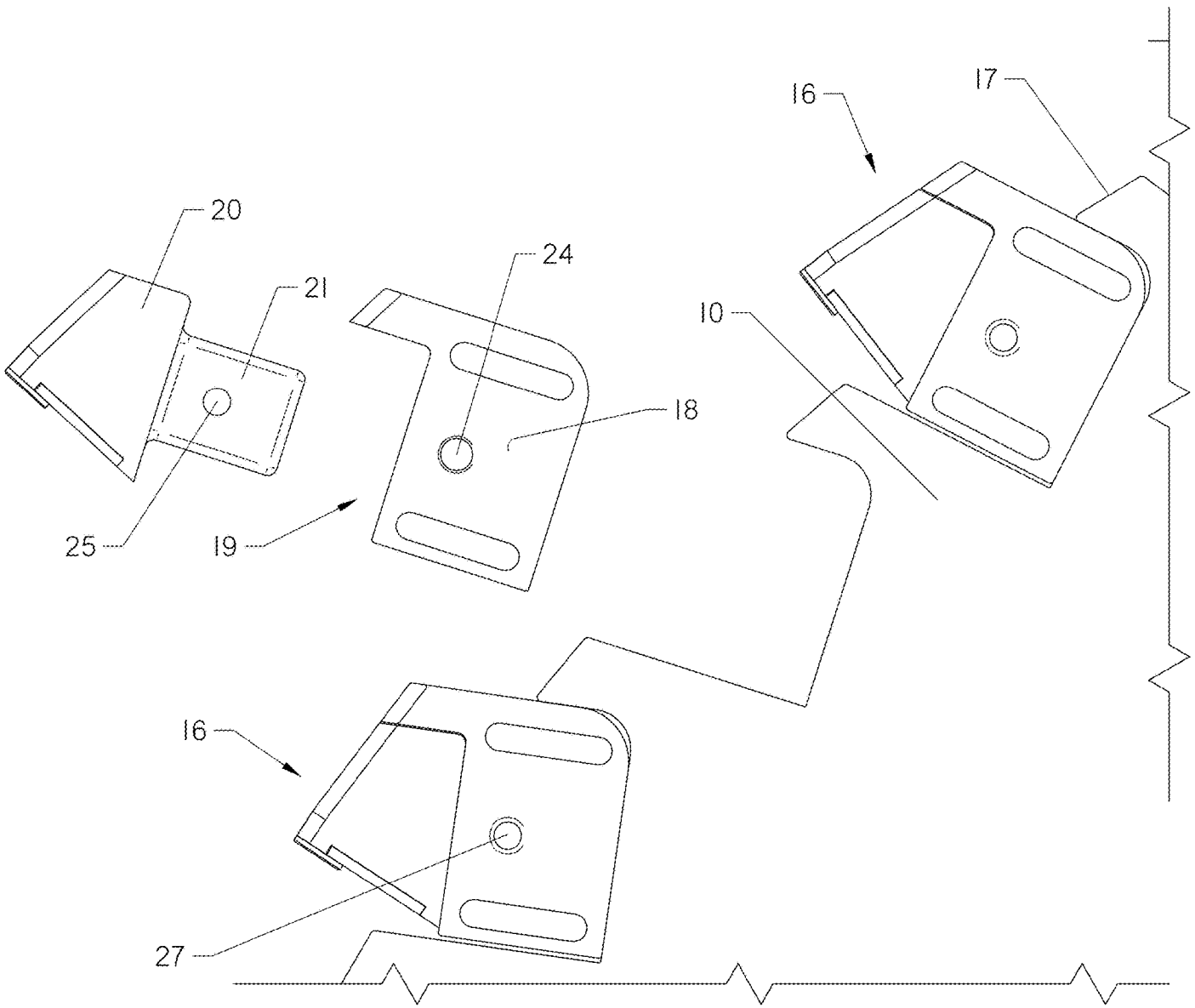
FIG. 3 is a close-up cut-away exploded side view of the microtrenching blade, with the tooth and cartridge shown removed from the periphery of the blade.

A plurality of tooth structures 16 are disposed about a periphery 17 of the blade 10. The tooth structures 16 comprise a cartridge 18 and a tooth 20. As best shown in FIG. 3, the cartridge 18 is fitted to the periphery 17 of the blade 10, and attached by welding or other known mechanisms.

Figure 4A:
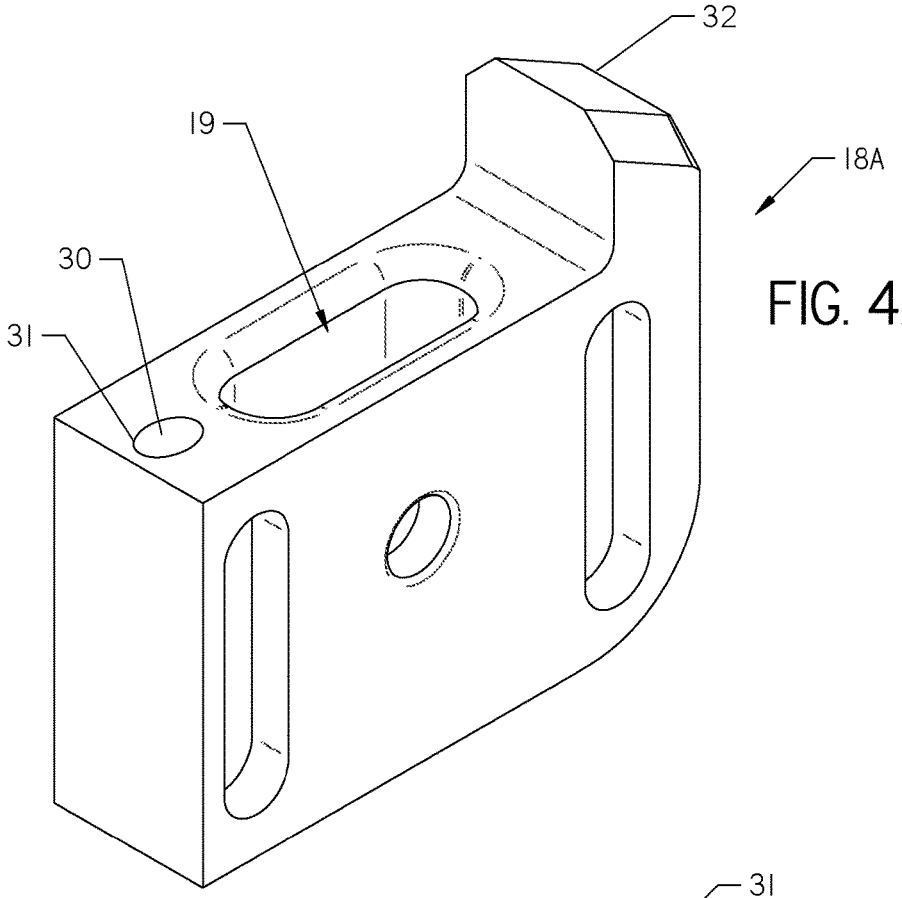
FIG. 4A is a front left top view of a first embodiment of the cartridge, with a vertically-oriented hole for placement of a rubber pin which is not shown.
Figure 4B:
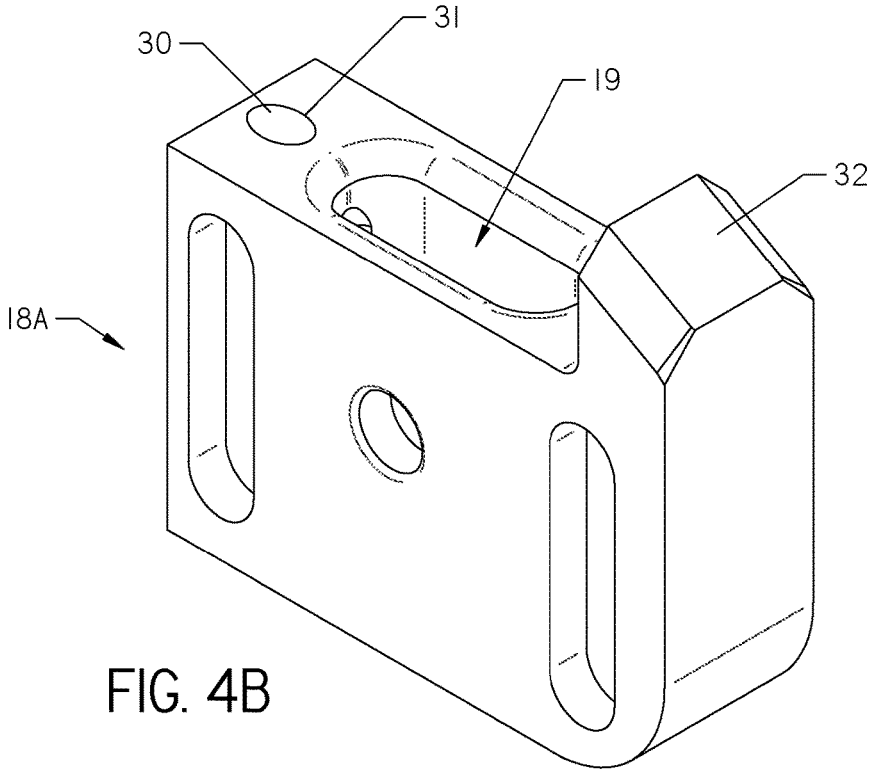
FIG. 4B is a back left top view thereof.
Figure 4C:
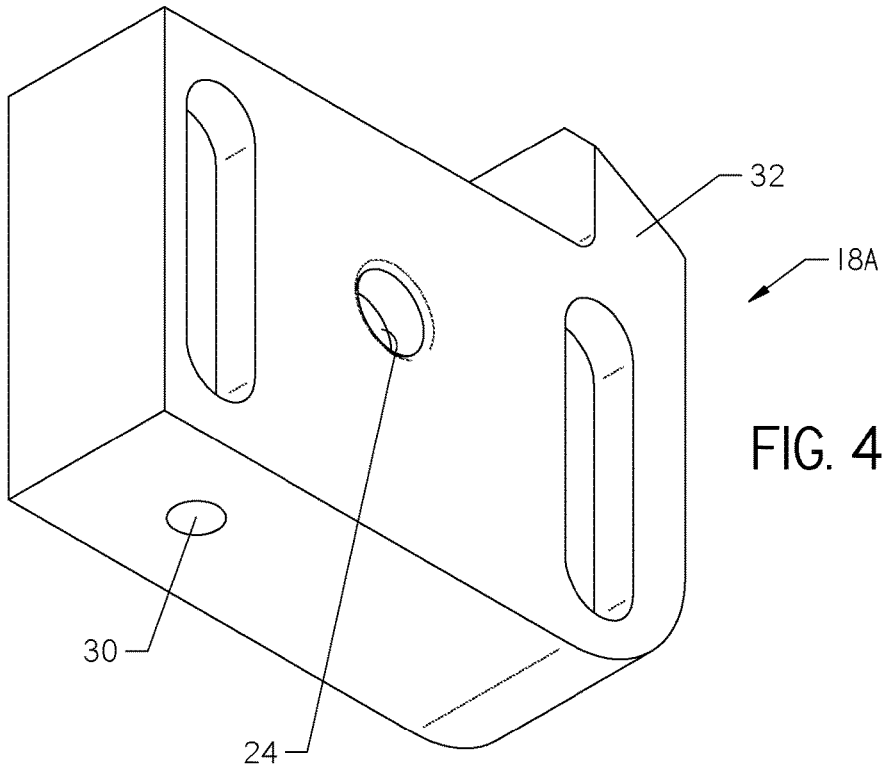
FIG. 4C is a bottom left front view thereof.
Figure 4D:
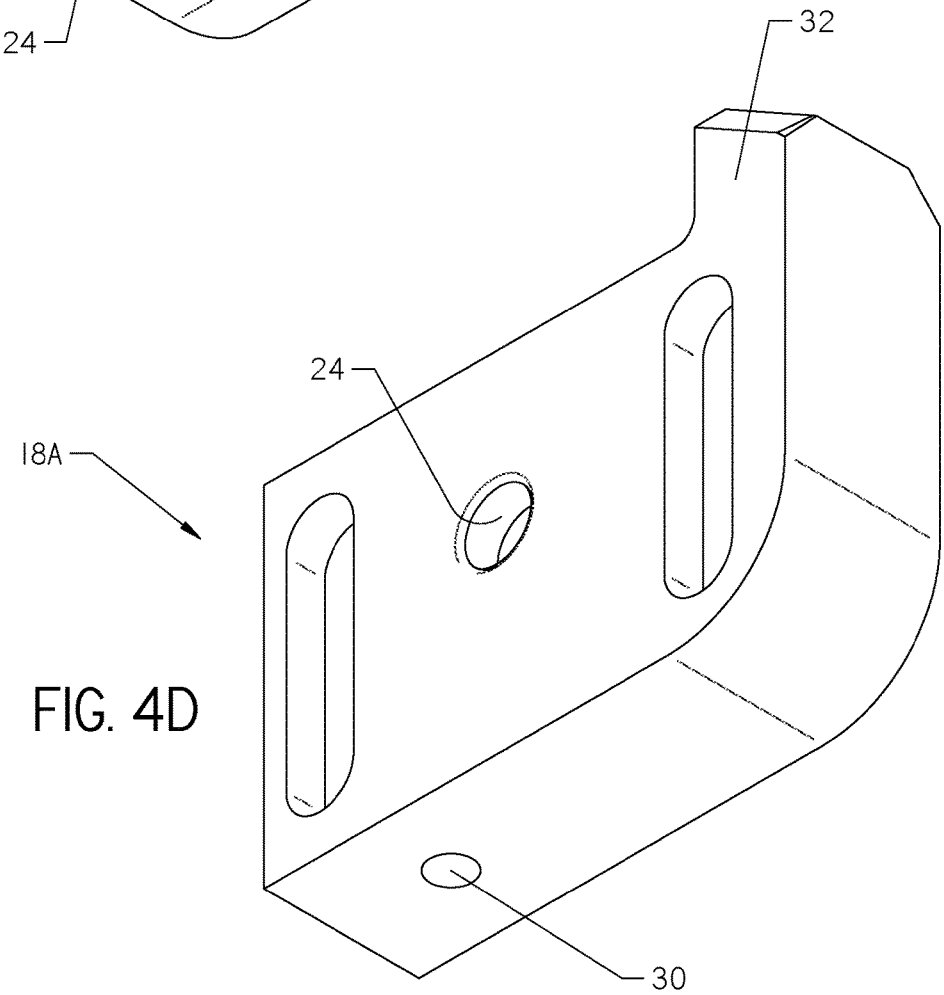
FIG. 4D is a back bottom left view thereof.
Figure 4E:
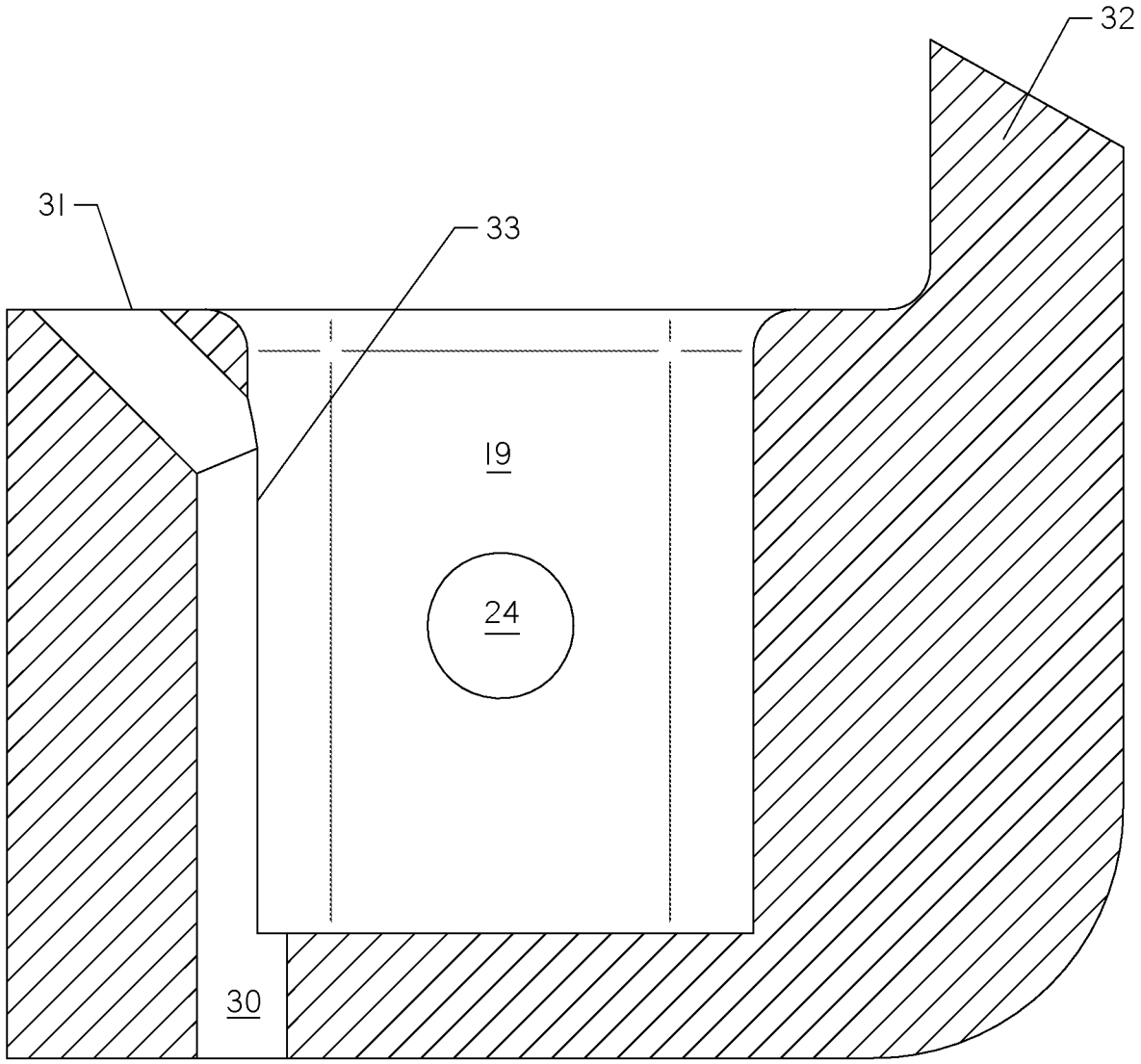
FIG. 4E is a sectional side view thereof.
Figure 5A:
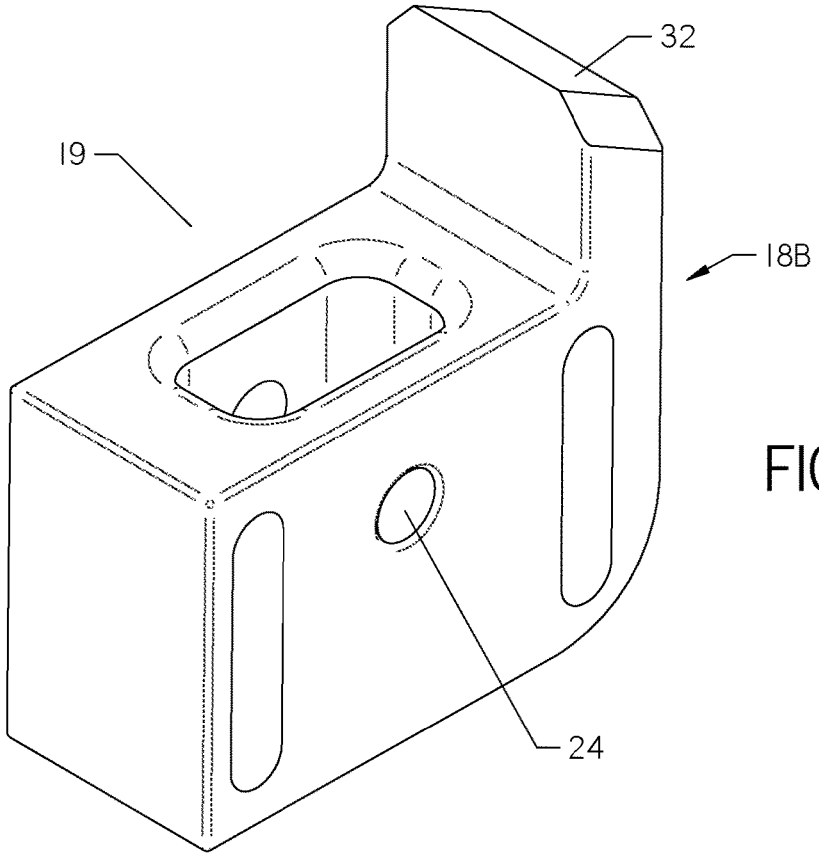
FIG. 5A is a top front left view of a second embodiment of a cartridge, without the vertically-oriented hole shown in FIGS. 4A-4E.
Figure 5B:
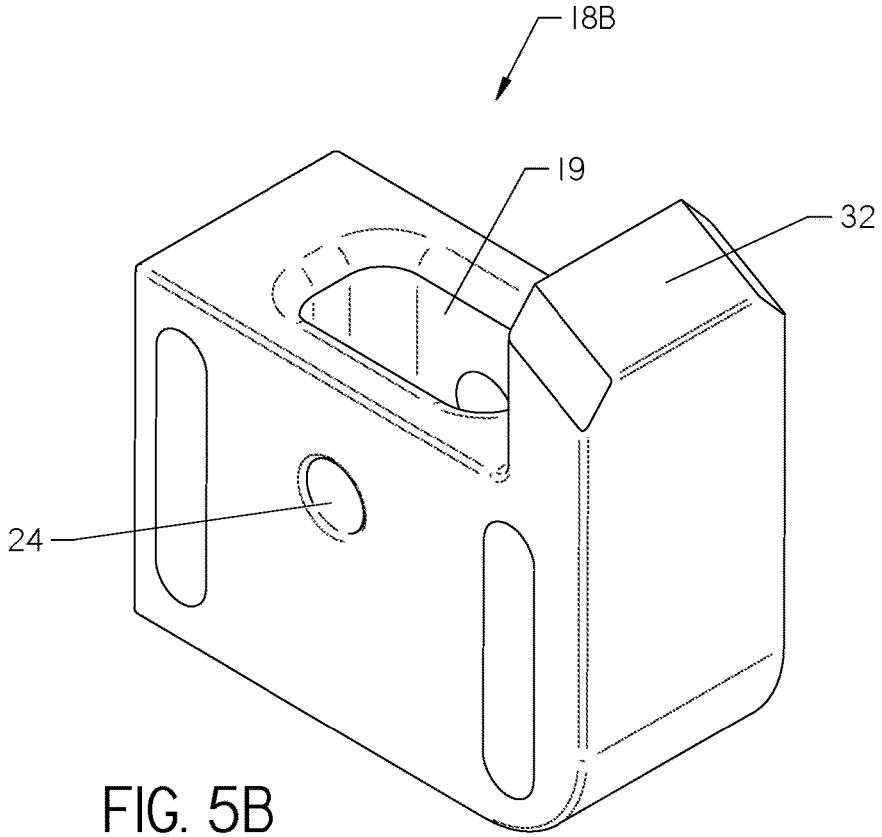
FIG. 5B is a back left top view thereof.
Figure 5C:
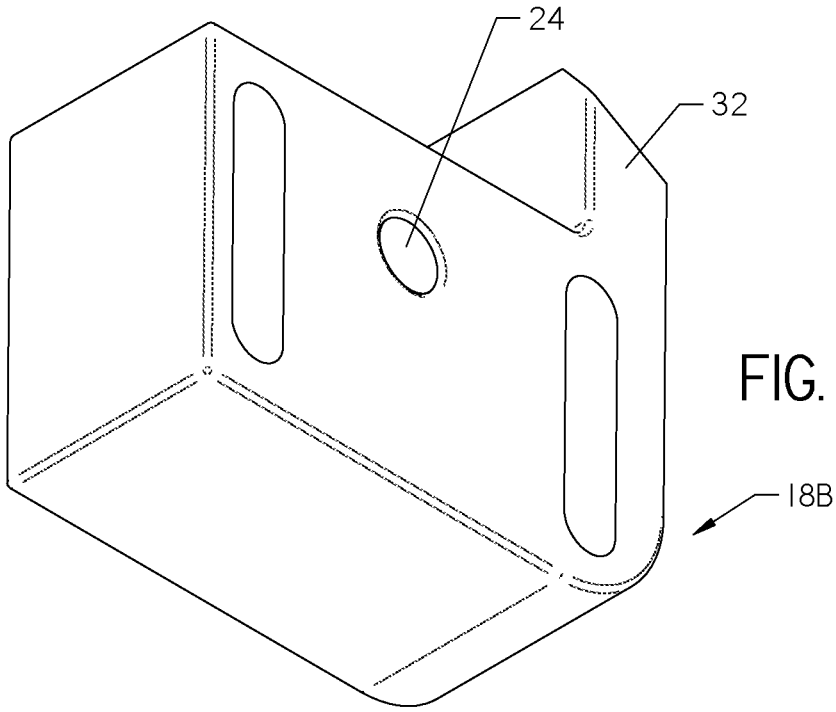
FIG. 5C is a front left bottom view thereof.
Figure 5D:
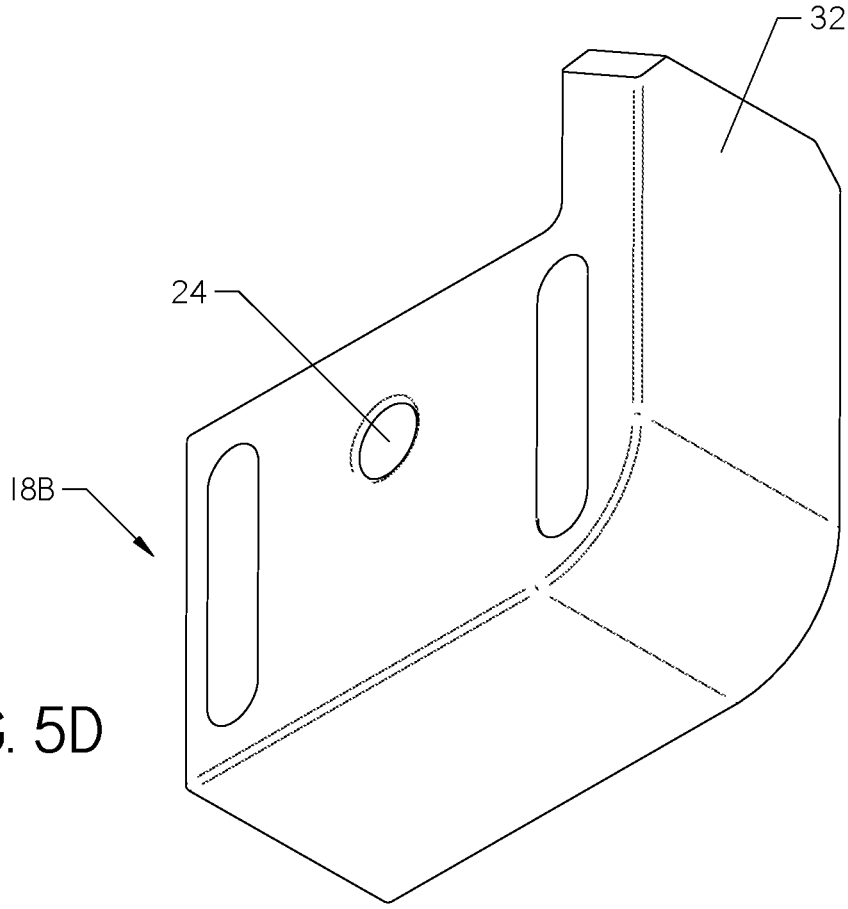
FIG. 5D is a back left bottom view thereof.
Figure 6A:
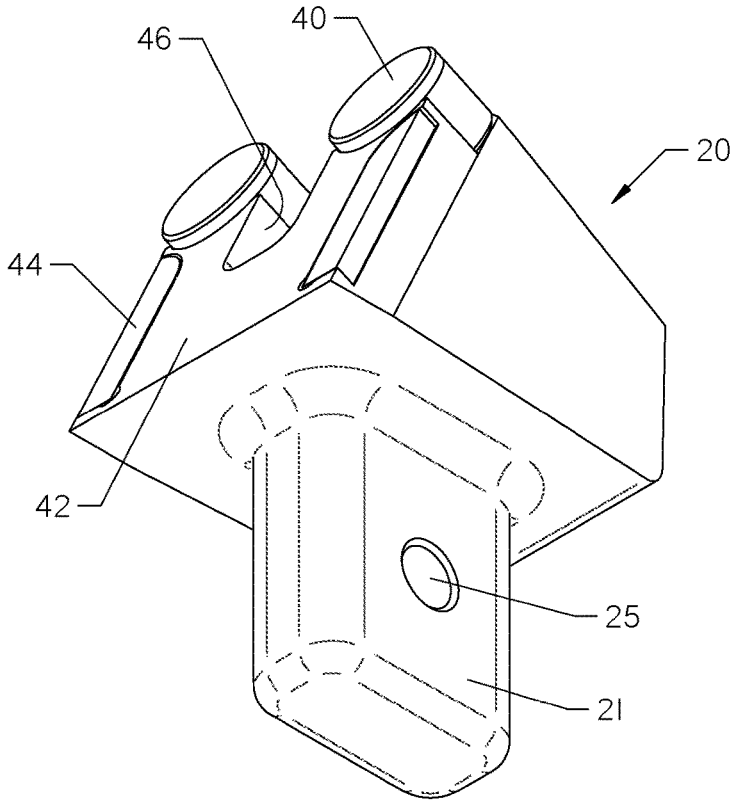
FIG. 6A is a bottom left front view of a tooth insert for use with the cartridges of FIGS. 4A-5D.
Figure 6B:
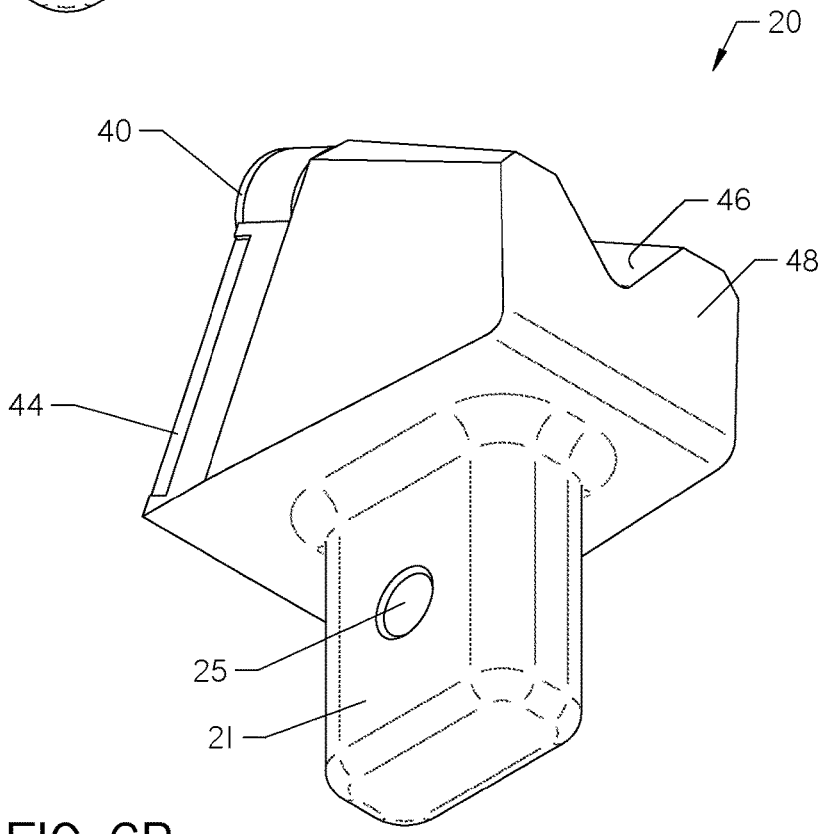
FIG. 6B is a back left bottom view thereof.
Figure 6C:
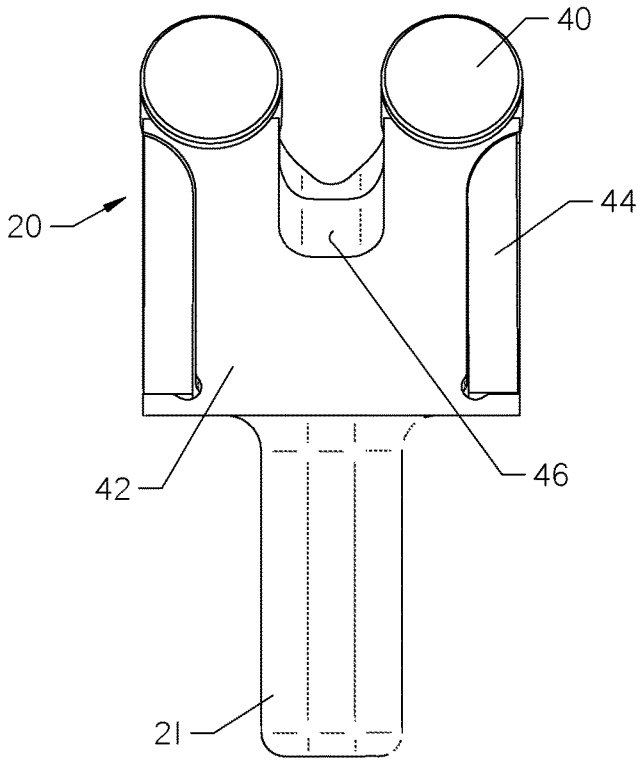
FIG. 6C is a front view thereof.
Figure 6D:
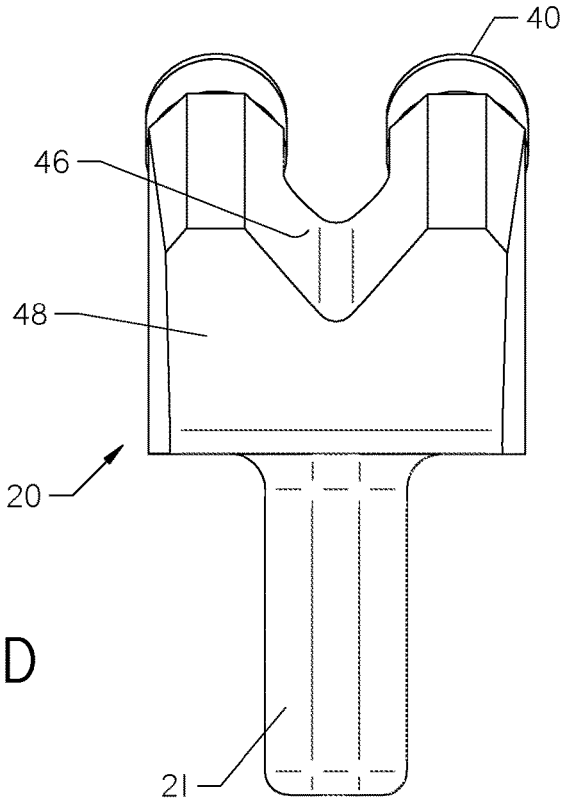
FIG. 6D is a back view thereof.
Figure 6E:
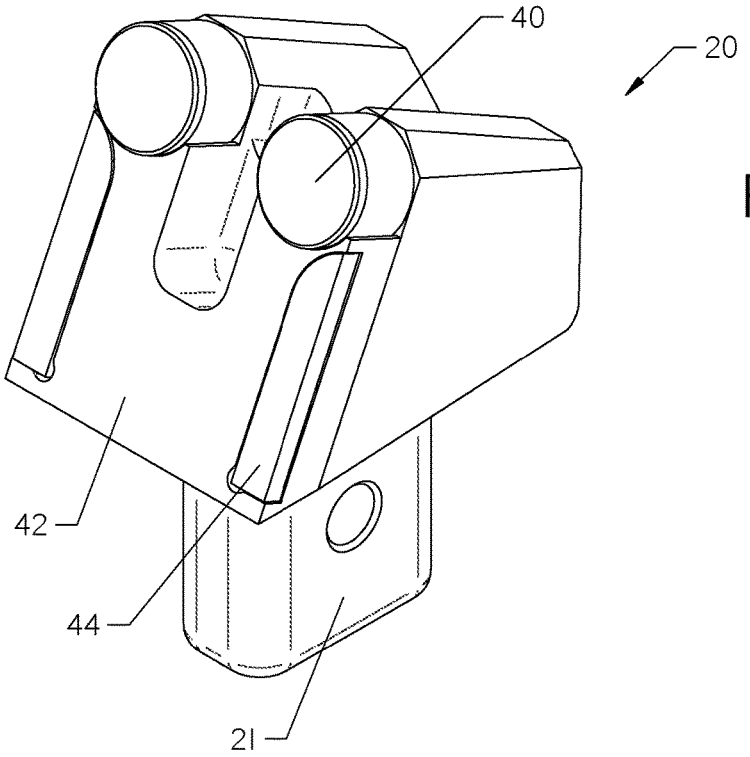
FIG. 6E is a front left top view thereof.
Figure 6F:
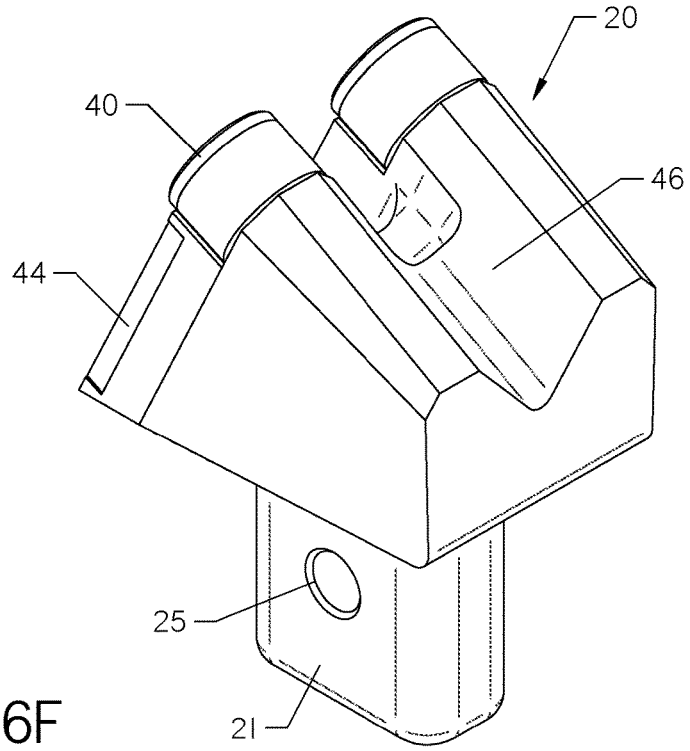
FIG. 6F is a back left top view thereof.

The tooth 20 is configured for insertion into the cartridge 18. As shown in FIGS. 4A, 4B and 4E, each cartridge 18 has an inner cavity 19. The tooth 20 comprises a projection 21 which conforms to a profile of the inner cavity. The projection 21 has a transverse hole 25 disposed therethrough. When used in this context, "transverse" is relative to the direction of rotation of the blade 10—thus the "transverse" hole 25 is perpendicular to the direction of rotation as the blade 10 rotates about its center 11.

The cavity 19 opens on one side to receive the projection 21. The other sides of the cavity 19 are closed, to provide structural support to the projection 21 when it is located therein. When within the cavity 19, the projection 21 is bounded on each side by either the walls of the cartridge 18, or the body of the tooth 20.

The cartridge 18 also has a transverse hole 24 formed in each side of the cavity 19. In this way, the transverse holes 24 of the cartridge 18 and the transverse holes 25 of the projection 21 form a continuous passage when the projection 21 is within the inner cavity 19 such that the conforming and complementary profiles align. The tooth 20 may thus be attached to the cartridge 18 by placing a transverse pin 27 through complementary transverse holes 24, 25, as in the attached tooth structures 16 of FIG. 3. As shown in FIG. 3, the pin 27 extends entirely through a width of the projection 21 and through both sides of the cartridge 18.

When, as in the Figures, the projection 21 is roughly a rounded rectangular prism with a rounded terminal end, such a prism is bounded on five of its six sides by the cartridge 18. The cavity 19 is likewise complementary to the same shape, with one of six sides open to the external surface of the cartridge 18 and two of the remaining five sides including a transverse hole 24.

With reference to FIGS. 4A-4E, a particular embodiment of the cartridge 18 is shown, which will be referred to by reference numeral 18A. This embodiment 18A has a substantially radially-oriented channel 30, which opens to the cavity 19, as best shown in the cross-sectional view of FIG. 4E. For the purposes of this specification, "substantially radially" shall mean being primarily radial in direction, extending, primarily, from a position nearer to the center 11 of the blade 10 towards a position nearer to the periphery 17 of the blade, whether or not the channel 30 extends along a radius (and thus, if extended through the center of the blade).

In FIG. 4E, channel 30 is open within the cavity 19 at a first opening 33, and then angles away from the cavity 19 to a second opening 31 at a surface of the cartridge 18. The channel 30 is configured for placement of a rubber pin or shim which seats against the projection 21 of the tooth 20 when the tooth is within the cavity 19. The shim may compress, providing frictional resistance to the movement of the projection 21 within the cavity 19. In this way, the shim secures the projection 21 within the cavity 19, preventing relative movement within the tooth assembly 16 during operation, especially early in operation when empty spaces have yet to be filled with spoils. The substantially radial channel 30 may be open to the cavity 19 for an extended length, for example, as shown, over half the length of the channel 30. Preventing relative movement within the tooth assembly 16 improves the durability of the blade 10.

A protrusion 32 is provided on the cartridge 18A behind the direction of intended rotation of the blade 10. This protrusion provides additional support for the tooth when assembled to the cartridge 18A.

An alternative embodiment of the cartridge 18 is shown in FIGS. 5A-5D, and given reference numeral 18B. The cartridge 18B does not have a radially oriented hole 30, and the protrusion 32 is wider, allowing the cartridge 18B and its cavity 19 to accommodate a wider tooth 20.

With reference to FIGS. 6A-6F, a representative tooth 20 is shown. The tooth has a projection 21 with the transverse hole 24 shown. As shown, the tooth 20 comprises two round cutters 40 disposed on a forward face 42. Additional hardened surfaces 44 are inset on the forward face 42. These surfaces 44 may be carbide inserts or hardfacing material.

A channel 46 is formed between the round cutters 40. The channel reduces friction between the tooth 20 and the ground, as well as allowing space for spoils to move past the tooth 20. As shown, the channel 46 is u-shaped at the forward face 42 while transitioning to a v-shape at a rearward face 48. The forward face 42 extends outwardly further from the projection 21 than the rearward face 48, such that the cutters 40 are providing most of the contact between the tooth 20 (and blade 10) and the ground. The cutters may be diamond-tipped, carbide, or other hardened materials.

One of skill will appreciate that if the cutter 40 breaks or experiences excessive wear, the current design allows for the quick and efficient replacement of the tooth 20 within a cartridge 18 by unpinning the tooth assembly 16.

In operation, the blade 10 may have a tooth assembly 16 replaced without removing any welded feature, so long as the cartridge 18 is attached to the periphery 17 of the blade. Thus, the method of tooth 20 replacement comprises removal of the pin 27 from the transverse holes 24, 25 and removal of the projection 21 from the cavity 19. A replacement tooth 20 may then be placed with its projection 21 within the cavity 19, and the transverse holes 24, 25 pinned. If a radial channel 30 is being used, the shim may be removed for the process of changing the tooth 20, or may remain in the channel if the shim allows for the removal of the tooth.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

The invention claimed is:

1. A microtrenching blade comprising:

a disc having a substantially circular periphery and defining a radial direction extending from a center of the disc to any point about the substantially circular periphery; and a plurality of tooth assemblies configured for placement about a periphery of the microtrenching blade, each of the plurality of tooth assemblies comprising:

a cartridge having an external surface and an internal cavity defining an internal profile, the cartridge defining a substantially radial channel opening at a first side of the cartridge and intersecting the cavity;

wherein the internal cavity opens to the external surface of the cartridge at a first side; and wherein the cavity is intersected by a transverse hole extending from a second side of the external surface to an opposed third side of the external surface;

a tooth comprising:

a body; and a projection extending from the body, wherein the projection defines an external profile complementary to the internal profile of the internal cavity of the cartridge, and wherein a transverse hole is formed in the projection; and a shim, configured to compress against the projection of the tooth when the projection is within the internal cavity and the shim is within the substantially radial channel;

wherein the transverse hole of the projection and the transverse hole of the cartridge form a continuous passage when the projection is situated within the internal cavity of the cartridge.

2. The microtrenching blade of claim 1 in which the shim is made of a rubber material.

3. The microtrenching blade of claim 1 in which:

the projection is within the cavity;

the shim is within the channel; and the shim contacts the projection.

4. A method of replacing a tooth in the microtrenching blade of claim 1, wherein the tooth of one of the plurality of tooth assemblies is located in the cartridge, the method comprising:

removing a cross-pin from the continuous passage;

removing the projection from the cavity in the cartridge; and removing the shim from the substantially radial channel.

5. The method of claim 4 further comprising:

choosing a replacement tooth;

placing a projection of the replacement tooth into the cavity of the cartridge;

placing a cross-pin into the continuous passage formed by the transverse hole in the cartridge and an aligned transverse hole in the projection of the replacement tooth.

6. The method of claim 4 in which the substantially radial channel is open to the cavity of the cartridge along more than half of the length of the channel.

7. The method of claim 4 in which the tooth comprises a forward face supporting at least two cutters.

8. The microtrenching blade of claim 1 further comprising:

a cross-pin configured for placement within the continuous passage.

9. The-microtrenching blade of claim 1 wherein:

the body extends from the projection to a terminal end, and comprises two cutters disposed at the terminal end on a forward face;

wherein a channel is defined on the body between the cutters and extends from the forward face to a rearward face.

10. The microtrenching blade of claim 9 in which the channel is u-shaped at the forward face and v-shaped at the rearward face.

11. The microtrenching blade of claim 9 in which the cutters are made of a harder material than the body.

12. The microtrenching blade of claim 1 in which:

each of the plurality of tooth assemblies is placed about the periphery of the microtrenching blade;

the cartridge of each of the plurality of tooth assemblies and the tooth of each of the plurality of tooth assemblies are assembled such that the projection is within the cavity and the transverse hole of the projection and transverse hole of the cartridge form the continuous passage.

13. The microtrenching blade of claim 12 in which a cross-pin is placed within the continuous passage.

14. The microtrenching blade of claim 13 in which the shim of each of the plurality of tooth assemblies is disposed within a corresponding substantially radial channel.

* * * * *